US010504529B2

(12) United States Patent
Sun

(10) Patent No.: US 10,504,529 B2
(45) Date of Patent: Dec. 10, 2019

(54) BINAURAL AUDIO ENCODING/DECODING AND RENDERING FOR A HEADSET

(71) Applicant: Cisco Technology, Inc., San Jose, CA (US)

(72) Inventor: Haohai Sun, Nesbru (NO)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 15/807,806

(22) Filed: Nov. 9, 2017

(65) Prior Publication Data

US 2019/0139554 A1 May 9, 2019

(51) Int. Cl.

| | |
|---|---|
| ***H04S 7/00*** | (2006.01) |
| ***G10L 19/008*** | (2013.01) |
| ***H04S 1/00*** | (2006.01) |
| *G10L 19/16* | (2013.01) |
| *G10L 21/0216* | (2013.01) |

(52) U.S. Cl.
CPC ..... *G10L 19/008* (2013.01); *H04S 1/005* (2013.01); *H04S 7/304* (2013.01); *G10L 19/167* (2013.01); *G10L 2021/02166* (2013.01); *H04S 2420/01* (2013.01)

(58) Field of Classification Search
CPC ..... H04S 2420/01; H04S 2400/15
See application file for complete search history.

(56) References Cited

U.S. PATENT DOCUMENTS

| | | | | |
|---|---|---|---|---|
| 4,131,760 | A | 12/1978 | Christensen et al. | |
| 7,116,787 | B2 * | 10/2006 | Faller | H04M 3/56 381/17 |
| 9,009,057 | B2 | 4/2015 | Breebaart et al. | |

(Continued)

FOREIGN PATENT DOCUMENTS

| | | | |
|---|---|---|---|
| WO | 2015013058 | A1 | 1/2015 |
| WO | 2016004225 | A1 | 1/2016 |

OTHER PUBLICATIONS

A. Farina, et al., "Spatial PCM Sampling: A New Method for Sound Recording and Playback", AES 52nd International Conference, Guildford, UK, Sep. 2-4, 2013, 12 pages.

(Continued)

*Primary Examiner* — Kile O Blair
(74) *Attorney, Agent, or Firm* — Edell, Shapiro & Finnan, LLC

(57) ABSTRACT

A method and apparatus for providing binaural audio for a headset is provided. In one embodiment, a method includes encoding audio signals to provide binaural audio to a headset. The method includes receiving audio signals from a microphone array comprising a first plurality of elements and applying far-field array processing to the audio signals to generate a first plurality of channels. The channels can be beam channels and each channel is associated with a particular beam angle. The method further includes selecting a second plurality of channels from the first plurality of channels that is a subset of the first plurality of channels. The method includes encoding the audio signals from the selected second plurality of channels with information associated with the particular beam angle for each of the selected second plurality of channels. The encoded audio signals are configured to provide binaural audio to a headset.

20 Claims, 6 Drawing Sheets

(56) References Cited

U.S. PATENT DOCUMENTS

| | | | | |
|---|---|---|---|---|
| 9,232,309 | B2 | 1/2016 | Zheng et al. | |
| 9,288,576 | B2 | 3/2016 | Togami et al. | |
| 9,530,421 | B2 | 12/2016 | Jot et al. | |
| 9,560,467 | B2 | 1/2017 | Gorzel et al. | |
| 9,602,947 | B2 | 3/2017 | Oh et al. | |
| 9,813,811 | B1 | 11/2017 | Sun | |
| 9,955,277 | B1 * | 4/2018 | Alexandridis | H04R 3/005 |
| 2011/0002469 | A1 | 1/2011 | Ojala | |
| 2011/0158418 | A1 | 6/2011 | Bai et al. | |
| 2014/0241528 | A1 | 8/2014 | Gunawan et al. | |
| 2016/0227337 | A1 | 8/2016 | Goodwin et al. | |
| 2017/0171396 | A1 | 6/2017 | Sun | |
| 2017/0188172 | A1 * | 6/2017 | Horbach | H04R 5/0335 |
| 2017/0353812 | A1 * | 12/2017 | Schaefer | H04S 7/303 |
| 2018/0206038 | A1 * | 7/2018 | Tengelsen | H04R 5/027 |
| 2018/0359562 | A1 | 12/2018 | Skramstad et al. | |

OTHER PUBLICATIONS

H. Sun et al., "Optimal Higher Order Ambisonics Encoding With Predefined Constraints", IEEE Transactions on Audio, Speech, and Language Processing, vol. 20, No. 3, Mar. 2012, 13 pages.

"Microphone Array", Microsoft Research, http://research.microsoft.com/en-us/projects/microphone_array/, downloaded from the internet on Mar. 29, 2016, 4 pages.

S. Yan et al., "Optimal Modal Beamforming for Spherical Microphone Arrays", IEEE Tranasactions on Audio, Speech, and Language Processing, vol. 19, No. 2, Feb. 2011, 11 pages.

Joseph T. Khalife, "Cancellation of Acoustic Reverberation Using Adaptive Filters", Center for Communications and Signal Processing, Department of Electrical and Computer Engineering, North Carolina State University, Dec. 1985, CCSP-TR-85/18, 91 pages.

Shefeng Yan, "Broadband Beamspace DOA Estimation: Frequency-Domain and Time-Domain Processing Approaches", Hindawi Publishing Corporation, EURASIP Journal on Advances in Signal Processing, vol. 2007, Article ID 16907, doi:10.1155/2007/16907, Sep. 2006, 10 pages.

Wen Zhang et al., "Surround by Sound: A Review of Spatial Audio Recording and Reproduction", Appl. Sci. 2017, 7, 532; doi:10.3390/app7050532, Mar. 14, 2017, 19 pages.

H. Sun, et al., Abstract of "Design 3-d high ambisonics encoding matrices using convex optimization," published May 13, 2011, Audio Engineering Society, http://www.aes.org/e-lib/browse.cfm?elib=15869, 2 pages.

* cited by examiner

BINAURAL AUDIO ENCODING/DECODING AND RENDERING FOR A HEADSET

TECHNICAL FIELD

This disclosure relates generally to three-dimensional (3D) immersive audio for headsets.

BACKGROUND

Augmented Reality (AR) and Virtual Reality (VR) allow a user to experience artificial sensory simulations that are provided with assistance by a computer. AR typically refers to computer-generated simulations that integrate real-world sensory input with overlaid computer-generated elements, such as sounds, videos, images, graphics, etc. VR typically refers to an entirely simulated world that is computer-generated. In both AR and VR environments, a user may interact with, move around, and otherwise experience the environment from the user's perspective. AR/VR technology is being used in a variety of different industries, such as virtual communication for consumers and businesses, gaming, manufacturing and research, training, and medical applications.

DESCRIPTION OF EXAMPLE EMBODIMENTS

Overview

Presented herein is a method and apparatus for providing binaural audio for a headset. In an example embodiment, a method of encoding audio signals to provide binaural audio to a headset is provided. The encoding method includes receiving audio signals from a microphone array comprising a first plurality of elements. The encoding method also includes applying far-field array processing to the audio signals received from the first plurality of elements of the microphone array to generate a first plurality of channels. The first plurality of channels are beam channels and each beam channel is associated with a particular beam angle. The encoding method further includes selecting a second plurality of channels from the first plurality of channels. The second plurality of channels is a subset of the first plurality of channels. The encoding method includes encoding the audio signals from the selected second plurality of channels with information associated with the particular beam angle for each of the selected second plurality of channels. The encoded audio signals are configured to provide binaural audio to a headset.

In another example embodiment, a method of rendering binaural audio for a headset is provided. The rendering method includes receiving audio signals comprising a plurality of channels. Each channel may be associated with a particular beam angle for that channel. The rendering method also includes receiving a signal associated with a head rotation angle from a head tracking sensor of a headset. The rendering method also includes determining a rotated beam angle for each of the particular beam angles associated with the plurality of channels. The rendering method includes generating a plurality of binaural audio signals by applying a head related transfer function to each channel of the plurality of channels. The rendering method further includes combining the plurality of binaural audio signals into a single binaural audio channel, and providing the single binaural audio channel to the headset.

Example Embodiments

Figure 1:
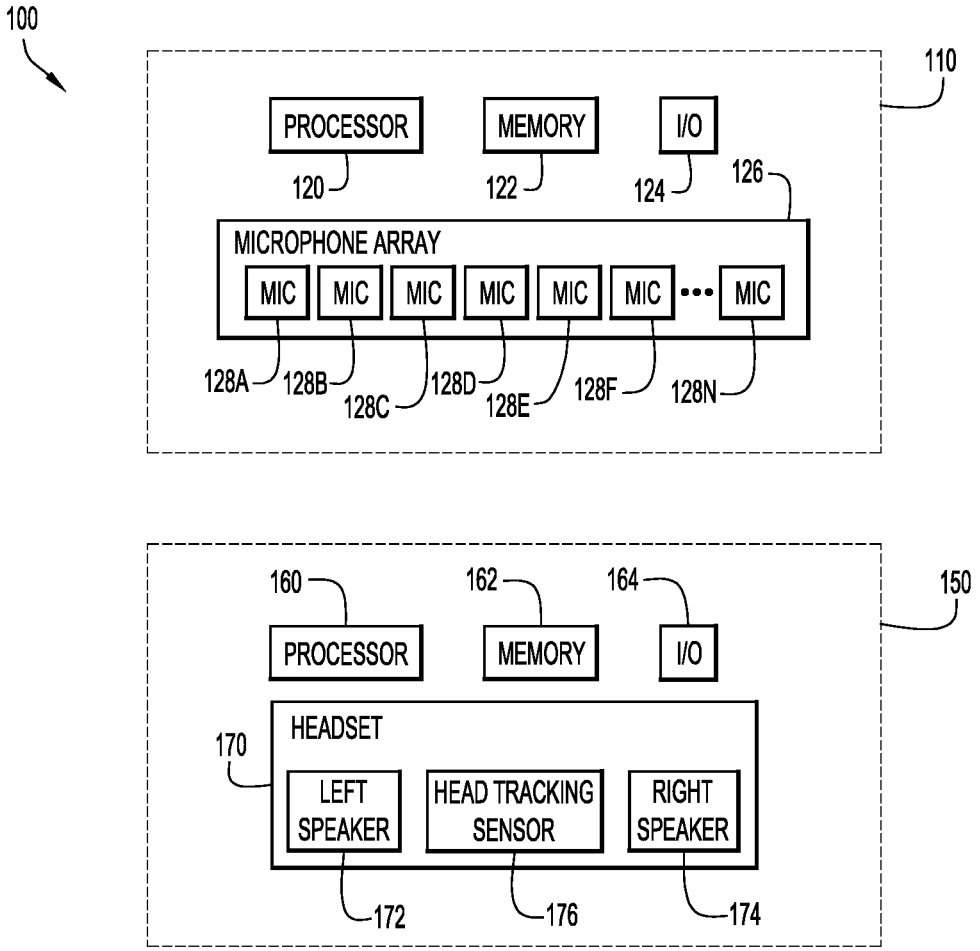
FIG. 1 is a block diagram showing a system for encoding audio signals and rendering binaural audio for a headset, according to an example embodiment.

FIG. 1 is a block diagram showing a system 100 for encoding audio signals and rendering binaural audio for a headset, according to an example embodiment. In this embodiment, system 100 includes an encoding apparatus 110 and a rendering apparatus 150. Encoding apparatus 110 is configured to capture or acquire audio signals and encode the signals to provide binaural audio according to the principles of the embodiments described herein. Rendering apparatus 150 is configured to decode and render the encoded audio signals to provide the binaural audio to the headset. In this embodiment, encoding apparatus 110 and rendering apparatus 150 may be separate devices. It should be understood, however, that in different embodiments, one or more functions of encoding apparatus 110 and/or rendering apparatus 150 may be performed by a single apparatus configured to provide both encoding and rendering functions. Alternatively, in still other embodiments, one or more functions of encoding apparatus 110 and/or rendering apparatus 150 may be performed by a plurality of separate and/or specialized devices or components. For example, one apparatus may capture, acquire, or record audio signals, another apparatus may encode the audio signals, and still another apparatus may decode and/or render binaural audio and provide it to a headset.

Encoding apparatus 110 may include components configured to at least perform the encoding functions described herein. For example, in this embodiment, encoding apparatus 110 can include a processor 120, a memory 122, an input/output (I/O) device 124, and a microphone array 126.

In an example embodiment, encoding apparatus 110 may be configured to capture or acquire audio signals from a plurality of microphone elements 128A-N of microphone array 126. Microphone array 126 may include any number of microphone elements that form the array. In this embodiment, plurality of microphone elements 128A-N of microphone array 126 includes at least a first microphone element 128A, a second microphone element 128B, a third microphone element 128C, a fourth microphone element 128D, a fifth microphone element 128E, a sixth microphone element 128F, and continuing to an nth microphone element 128N. Plurality of microphone elements 128A-N of microphone array 126 may have a variety of arrangements. For example, microphone array 126 may be a linear array, a planar array, a circular array, a spherical array, or other type of array. In some cases, the geometry of a microphone array may depend on the configuration of encoding apparatus 110.

Encoding apparatus 110 may further include a bus (not shown) or other communication mechanism coupled with processor 120 for communicating information between various components. While the figure shows a single block 120 for a processor, it should be understood that the processor 120 may represent a plurality of processing cores, each of which can perform separate processing functions.

Encoding apparatus 110 also includes memory 122, such as a random access memory (RAM) or other dynamic storage device (e.g., dynamic RAM (DRAM), static RAM (SRAM), and synchronous DRAM (SD RAM)), coupled to the bus for storing information and instructions to be executed by processor 120. For example, software configured to provide utilities/functions for capturing, encoding, and/or storing audio signals may be stored in memory 122 for providing one or more operations of encoding apparatus 110 described herein. The details of the processes implemented by encoding apparatus 110 according to the example embodiments will be described further below. In addition, memory 122 may be used for storing temporary variables or other intermediate information during the execution of instructions by processor 120.

Encoding apparatus 110 may also include I/O device 124. I/O device 124 allows input from a user to be received by processor 120 and/or other components of encoding apparatus 110. For example, I/O device 124 may permit a user to control operation of encoding apparatus 110 and to implement the encoding functions described herein. I/O device 124 may also allow stored data, for example, encoded audio signals, to be output to other devices and/or to storage media.

Encoding apparatus 110 may further include other components not explicitly shown or described in the example embodiments. For example, encoding apparatus 110 may include a read only memory (ROM) or other static storage device (e.g., programmable ROM (PROM), erasable PROM (EPROM), and electrically erasable PROM (EEPROM)) coupled to the bus for storing static information and instructions for processor 120. Encoding apparatus 110 may also include a disk controller coupled to the bus to control one or more storage devices for storing information and instructions, such as a magnetic hard disk, and a removable media drive (e.g., floppy disk drive, read-only compact disc drive, read/write compact disc drive, compact disc jukebox, tape drive, and removable magneto-optical drive). The storage devices may be added to encoding apparatus 110 using an appropriate device interface (e.g., small computer system interface (SCSI), integrated device electronics (IDE), enhanced-IDE (E-IDE), direct memory access (DMA), or ultra-DMA).

Encoding apparatus 110 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)), that, in addition to microprocessors and digital signal processors may individually, or collectively, are types of processing circuitry. The processing circuitry may be located in one device or distributed across multiple devices.

Encoding apparatus 110 performs a portion or all of the processing steps of the process in response to processor 120 executing one or more sequences of one or more instructions contained in a memory, such as memory 122. Such instructions may be read into memory 122 from another computer readable medium, such as a hard disk or a removable media drive. One or more processors in a multi-processing arrangement may also be employed to execute the sequences of instructions contained in memory 122. In alternative embodiments, hard-wired circuitry may be used in place of or in combination with software instructions. Thus, embodiments are not limited to any specific combination of hardware circuitry and software.

As stated above, encoding apparatus 110 includes at least one computer readable medium or memory for holding instructions programmed according to the embodiments presented, for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SD RAM, or any other magnetic medium, compact discs (e.g., CD-ROM), or any other optical medium, punch cards, paper tape, or other physical medium with patterns of holes, or any other medium from which a computer can read.

Stored on any one or on a combination of non-transitory computer readable storage media, embodiments presented herein include software for controlling encoding apparatus 110, for driving a device or devices for implementing the process, and for enabling encoding apparatus 110 to interact with a human user (e.g., print production personnel). Such software may include, but is not limited to, device drivers, operating systems, development tools, and applications software. Such computer readable storage media further includes a computer program product for performing all or a portion (if processing is distributed) of the processing presented herein.

The computer code devices may be any interpretable or executable code mechanism, including but not limited to scripts, interpretable programs, dynamic link libraries (DLLs), Java classes, and complete executable programs. Moreover, parts of the processing may be distributed for better performance, reliability, and/or cost.

In some embodiments, one or more functions of encoding apparatus 110 may be performed by any device that includes at least similar components that are capable of performing the encoding functions described in further detail below. For example, encoding apparatus 110 may be a telecommunications endpoint, an interactive whiteboard device, a smartphone, a tablet, a dedicated recording device, or other suitable electronic device having the components to capture and/or encode audio signals according to the principles described herein.

Rendering apparatus 150 may include components configured to at least perform the rendering functions described herein. For example, in this embodiment, rendering apparatus 150 can include a processor 160, a memory 162, an input/output (I/O) device 164, and a headset 170.

In an example embodiment, rendering apparatus 150 may be configured to decode and/or render binaural audio signals for headset 170. The rendered binaural audio signals may be provided to a left speaker 172 and a right speaker 174 of headset 170. Headset 170 may be any type of headset configured to play back binaural audio to a user or wearer. For example, headset 170 may be an AR/VR headset, headphones, earbuds, or other device that can provide binaural audio to a user or wearer. In the example embodiments described herein, headset 170 is an AR/VR headset that includes at least left speaker 172 and right speaker 174, as well as additional components, such as a display and a head tracking sensor.

Rendering apparatus 150 may further include a bus (not shown) or other communication mechanism coupled with processor 160 for communicating information between various components. While the figure shows a single block 160 for a processor, it should be understood that the processor 160 may represent a plurality of processing cores, each of which can perform separate processing functions.

Rendering apparatus 150 also includes memory 162, such as RAM or other dynamic storage device (e.g., DRAM, SRAM, and SD RAM), coupled to the bus for storing information and instructions to be executed by processor 160. For example, software configured to provide utilities/functions for decoding, rendering, and/or playing binaural audio signals may be stored in memory 162 for providing one or more operations of rendering apparatus 150 described herein. The details of the processes implemented by rendering apparatus 150 according to the example embodiments will be discussed further below. In addition, memory 162 may be used for storing temporary variables or other intermediate information during the execution of instructions by processor 160.

Rendering apparatus 150 may also include I/O device 164. I/O device 164 allows input from a user to be received by processor 160 and/or other components of rendering apparatus 150. For example, I/O device 164 may permit a user to control operation of rendering apparatus 150 and to implement the rendering functions described herein. I/O device 164 may also allow stored data, for example, encoded audio signals, to be received by rendering apparatus 150 (e.g., from encoding apparatus 110). I/O device 164 may also provide output to other devices and/or to storage media, such as providing binaural audio for headset 170 via a direct or indirect connection, or as a media file that may be executed or played by headset 170.

Rendering apparatus 150 may further include other components not explicitly shown or described in the example embodiments. For example, rendering apparatus 150 may include a ROM or other static storage device (e.g., PROM, EPROM, and EEPROM) coupled to the bus for storing static information and instructions for processor 160. Rendering apparatus 160 may also include a disk controller coupled to the bus to control one or more storage devices for storing information and instructions, such as a magnetic hard disk, and a removable media drive (e.g., floppy disk drive, read-only compact disc drive, read/write compact disc drive, compact disc jukebox, tape drive, and removable magneto-optical drive). The storage devices may be added to rendering apparatus 150 using an appropriate device interface (e.g., SCSI, IDE, E-IDE, DMA, or ultra-DMA).

Rendering apparatus 150 may also include special purpose logic devices (e.g., ASICs) or configurable logic devices (e.g., SPLDs, CPLDs, and FPGAs), that, in addition to microprocessors and digital signal processors may individually, or collectively, are types of processing circuitry. The processing circuitry may be located in one device or distributed across multiple devices.

Rendering apparatus 150 performs a portion or all of the processing steps of the process in response to processor 160 executing one or more sequences of one or more instructions contained in a memory, such as memory 162. Such instructions may be read into memory 162 from another computer readable medium, such as a hard disk or a removable media drive. One or more processors in a multi-processing arrangement may also be employed to execute the sequences of instructions contained in memory 162. In alternative embodiments, hard-wired circuitry may be used in place of or in combination with software instructions. Thus, embodiments are not limited to any specific combination of hardware circuitry and software.

As stated above, rendering apparatus 150 includes at least one computer readable medium or memory for holding instructions programmed according to the embodiments presented, for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SD RAM, or any other magnetic medium, compact discs (e.g., CD-ROM), or any other optical medium, punch cards, paper tape, or other physical medium with patterns of holes, or any other medium from which a computer can read.

Stored on any one or on a combination of non-transitory computer readable storage media, embodiments presented herein include software for controlling rendering apparatus 150, for driving a device or devices for implementing the process, and for enabling rendering apparatus 150 to interact with a human user (e.g., print production personnel). Such software may include, but is not limited to, device drivers, operating systems, development tools, and applications software. Such computer readable storage media further includes a computer program product for performing all or a portion (if processing is distributed) of the processing presented herein.

The computer code devices may be any interpretable or executable code mechanism, including but not limited to scripts, interpretable programs, DLLs, Java classes, and complete executable programs. Moreover, parts of the processing may be distributed for better performance, reliability, and/or cost.

In some embodiments, one or more functions of rendering apparatus 150 may be performed by any device that includes at least similar components that are capable of performing the rendering functions described in further detail below. For example, rendering apparatus 150 may be an AR/VR headset, a gaming computer, an interactive whiteboard device, a smartphone, a tablet, a dedicated rendering device, or other suitable electronic device having the components to decode and/or render binaural audio signals according to the principles described herein.

Figure 2:
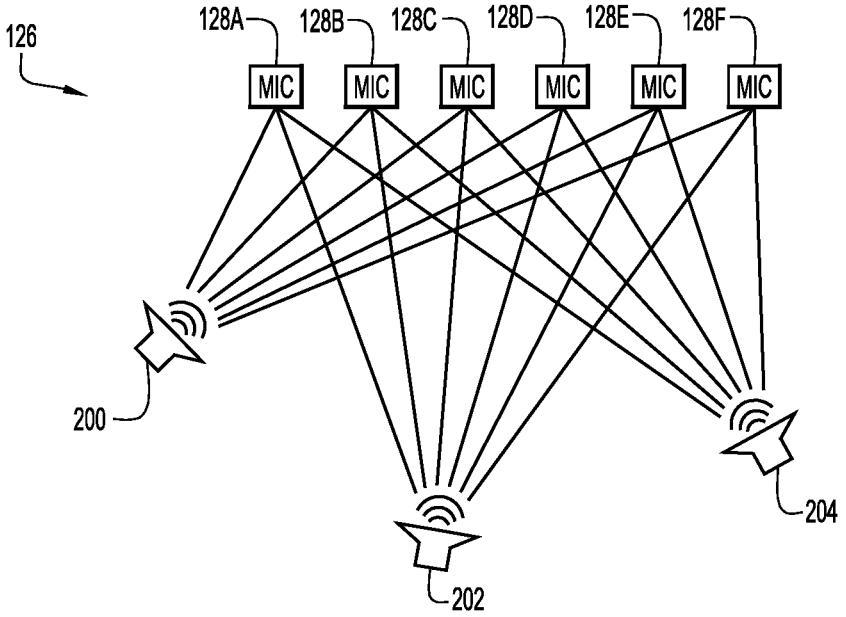
FIG. 2 is a diagram illustrating a microphone array capturing audio from sound sources, according to an example embodiment.

Referring now to FIG. 2, microphone array 126 of encoding apparatus 110 is shown capturing audio signals from a plurality of sound sources 200, 202, 204 according to an example embodiment. In this embodiment, microphone array 126 is a linear array that includes six individual microphone elements, including first microphone element 128A, second microphone element 128B, third microphone element 128C, fourth microphone element 128D, fifth microphone element 128E, and sixth microphone element 128F. Microphone array 126 is configured to capture multi-channel 3D audio signals in an environment, such as a meeting, having one or more sound sources. In this embodiment, the environment has at least three sound sources, including a first source 200, a second source 202, and a third source 204.

In this embodiment, each sound source may have a different orientation and/or position within the environment. Thus, first source 200, second source 202, and third source 204 will each have varying distances to plurality of microphone elements 128A-F of microphone array 126, as well as different orientations with respect to individual microphone elements of microphone array 126. For example, first source 200 is located closer to first microphone element 128A than second source 202 and/or third source 204. First source 200 also has a different orientation towards first microphone element 128A than the orientations of each of second source 202 and/or third source 204. The principles of the present embodiments described herein can provide a user with binaural audio for a headset that can recreate or simulate these different orientations and positions of first source 200, second source 202, and third source 204 within the environment.

FIG. 2 illustrates a representative configuration of microphone array 126 of encoding apparatus 110 according to one example embodiment. In another example embodiment, encoding apparatus 110 may be an interactive whiteboard device that includes microphone array 126 having approximately 12 microphone elements arranged as a linear array configuration. As noted above, however, microphone array 126 may have any number of microphone elements configured in any type of geometric array.

Figure 3:
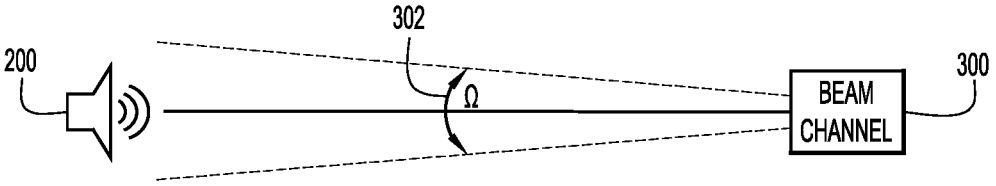
FIG. 3 is a representative diagram of a beam channel, according to an example embodiment.

As will be described in detail below, once audio signals for the plurality of sound sources (e.g., sources 200, 202, 204) are captured or acquired by microphone array 126 of encoding apparatus 110, far-field array processing may be applied to the signals from plurality of microphone elements 128A-F. Far-field array processing may include various operations performed on the audio signals, such as one or more of beamforming, de-reverberation, echo cancellation, non-linear processing, noise reduction, automatic gain control, or other processing techniques, to generate a plurality of beam channels. Referring now to FIG. 3, a representative example of a beam channel 300 of the plurality of beam channels that may be generated from the audio signals from plurality of microphone elements 128A-F after far-field array processing, is shown.

In this embodiment, representative beam channel 300 is pointed to a particular beam angle (Ω) 302 in the full 3D space of the environment. The particular beam angle (Ω) 302 for beam channel 300 is a fixed angle. The far-field array processing applied to the signals from plurality of microphone elements 128A-F generates a first plurality of beam channels, where each beam channel may be associated with its own particular beam angle (Ω). Additionally, the far-field array processing performed on the audio signals from the plurality of microphone elements may generate the same or different number of beam channels with associated particular beam angles.

For example, consider a case where audio signals from Mmicrophone elements are far-field array processed to generate N beam channels with associated particular beam angles. N may be equal to M so that the number of beam channels is the same as the number of microphone elements, N may be larger than M, so that the number of beam channels is greater than the number of microphone elements, or N may be smaller than M, so that the number of beam channels is less than the number of microphone elements. Taken together, the first plurality of beam channels may be configured to cover between at least 180 to 360 degrees of the 3D space of the environment. In some cases, the beam channels may cover between at least 270 to 360 degrees of the 3D space of the environment.

Figure 4:
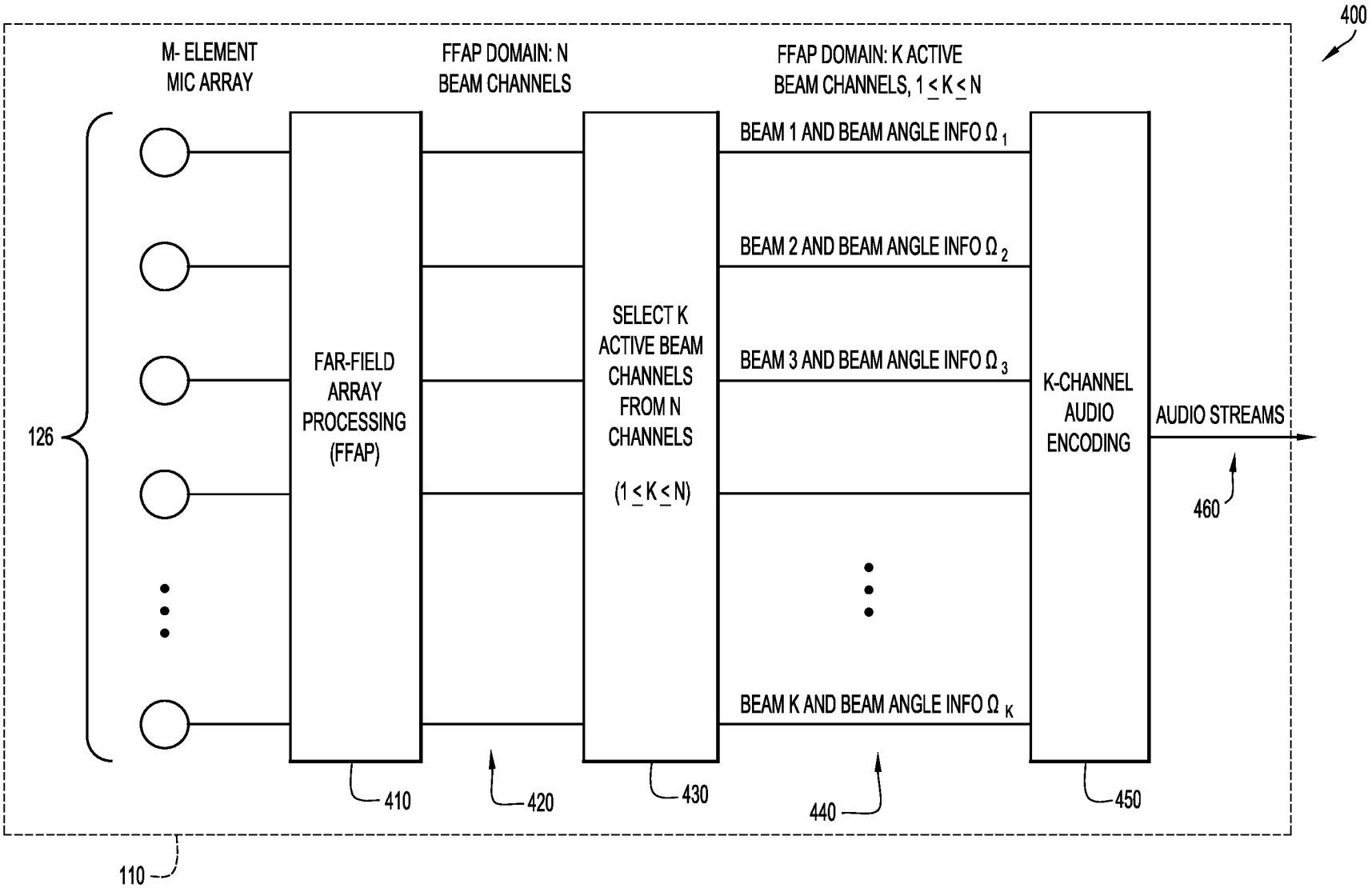
FIG. 4 is a functional block diagram of a process for encoding audio signals, according to an example embodiment.

FIG. 4 is a functional block diagram of a process 400 for encoding audio signals, according to an example embodiment. In this embodiment, process 400 is performed by encoding apparatus 110 using microphone array 126, as described above. Microphone array 126 may include a plurality of microphone elements (M elements) that are used to capture or acquire audio signals from one or more sound sources in an environment. For example, the environment may be a meeting, conference, or other setting having one or more sound sources that may be captured or recorded. Once the audio signals are captured by the microphone elements of microphone array 126, far-field array processing (FFAP) is applied to the audio signals at FFAP block 410. FFAP applied to the audio signals may include various operations, such as one or more of beamforming, de-reverberation, echo cancellation, non-linear processing, noise reduction, automatic gain control, or other processing techniques, to generate a plurality of beam channelsfie 420 (N beam channels).

In this embodiment, FFAP block 410 outputs plurality of beams channels 420, with each beam channel being associated with a particular beam angle (Ω, as shown in FIG. 3) in the full 3D space. In other embodiments, however, FFAP block 410 may be configured to output N virtual microphone channels or N sub-sound field channels.

Next, process 400 includes a channel selection block 430 where a second plurality of beam channels are selected as a subset of the plurality of beam channels 420 based on satisfying a defined activity criteria. The defined activity criteria used at channel selection block 430 causes the most active channels (K active beam channels) of the plurality of beam channels 420 (N beam channels) to be selected as the subset of beam channels 420 ($1 \leq K \leq N$). The defined activity criteria is a scalar factor for performance and bandwidth tradeoff, i.e., a larger number of selected channels may increase spatial audio resolution but require a higher bandwidth consumption. In this embodiment, the defined activity criteria used to select the most active channels may be based on one or more of a sound pressure level, a sound pressure ratio, a signal-to-noise ratio, or a signal-to-reverberation ratio. In other embodiments, different defined activity criteria may be used to determine which channels of the plurality of beam channels 420 should be selected as the most active channels that comprise the second plurality of beam channels.

After the second plurality of beam channels (K active beam channels) are selected at channel selection block 430, the second plurality of beam channels and their associated particular beam angles (Ω) 440 are provided to an audio encoding block 450. As noted above, each of the beam channels of the second plurality of beam channels may be associated with a corresponding particular beam angle ($\Omega_1$–$\Omega_K$). Taken together, the second plurality of beam channels may be configured to cover at least 180 degrees.

At audio encoding block 450, each of the beam channels are encoded with information associated with the particular beam angle (Ω) for that channel. For example, as shown in FIG. 4, the second plurality of beam channels and their associated particular beam angles (Ω) 440 can include at least a first beam channel with a first particular beam angle ($\Omega_1$), a second beam channel with a second particular beam angle ($\Omega_2$), a third beam channel with a third particular beam angle ($\Omega_3$), and continuing through a Kth beam channel with a Kth particular beam angle ($\Omega_K$). Audio encoding block 450 may encode each of these beam channels with its associated particular beam angle to provide encoded audio signals 460.

Additionally, in another embodiment, audio encoding block 450 may encode other information with the audio signal for each beam channel, for example, an indicator that associates a beam channel with its corresponding particular beam angle. The indicator may be a beam identifier (ID) number that provides information that represents a particular beam angle association with a beam channel. The beam ID numbers may be retrieved from a table or other stored data entry by rendering apparatus 150. Encoding the beam channel with a beam ID may provide a lower spatial resolution compared with encoding the beam channel with the particular beam angle that may be sufficiently robust for a particular rendering apparatus or headset configuration.

Figure 5:
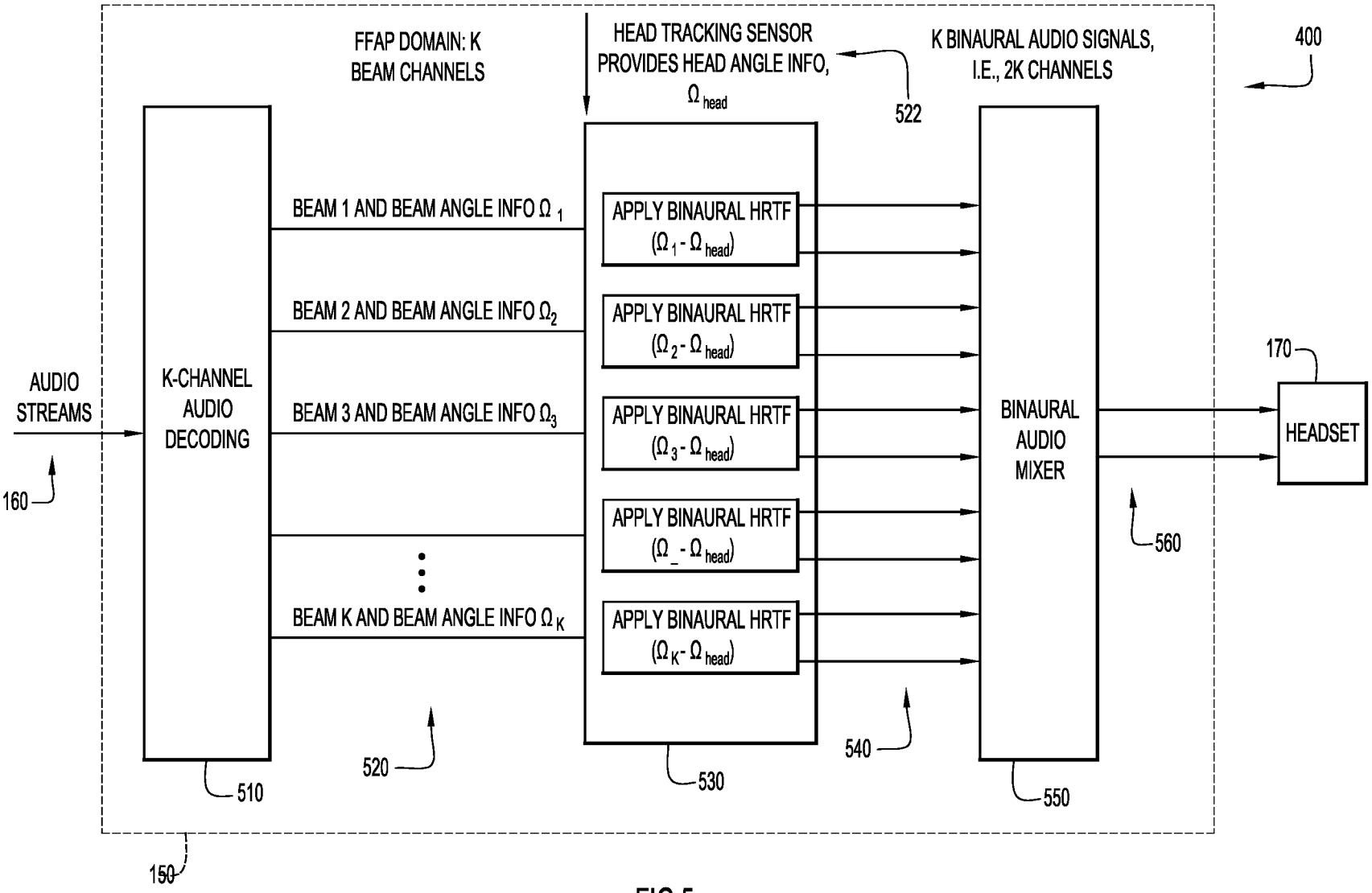
FIG. 5 is a functional block diagram of a process for rendering binaural audio for a headset, according to an example embodiment.

FIG. 5 is a diagram illustrating a logical view of a process 500 for rendering binaural audio for a headset, according to an example embodiment. In this embodiment, process 500 for rendering binaural audio for a headset, for example, headset 170, is performed by rendering apparatus 150, as described above. Process 500 may begin by receiving encoded audio signals 460, for example, received from encoding apparatus 110, that include a plurality of channels encoded with particular beam angles for each channel.

The encoded audio signals 460 are received by an audio decoding block 510. Audio decoding block 510 decodes audio signals 460 to extract a plurality of beam channels (K channels) and the associated particular beam angles for each beam channel (K beam angles, Ω). Audio decoding block 510 provides the plurality of beam channels and their associated particular beam angles (Ω) 520 to a binaural audio calculation block 530. The plurality of beam channels and their associated particular beam angles (Ω) 520 can include at least a first beam channel with a first particular beam angle ($\Omega_1$), a second beam channel with a second particular beam angle ($\Omega_2$), a third beam channel with a third particular beam angle ($\Omega_3$), and continuing through a Kth beam channel with a Kth particular beam angle ($\Omega_K$).

At binaural audio calculation block 530, a signal 522 associated with a head rotation angle ($\Omega_{head}$) is received from a head tracking sensor of a headset, for example, from a head tracking sensor 176 associated with headset 170. Binaural audio calculation block 530 then determines rotated beam angles for each of the plurality of particular beam angles (e.g., K rotated beam angles for K beam angles, Ω) associated with the plurality of beam channels. For example, binaural audio calculation block 530 may determine the rotated beam angle by subtracting the head rotation angle ($\Omega_{head}$) from the particular beam angle (Ω), i.e., for K beam angles, rotated beam angle=$\Omega_k-\Omega_{head}$, for each k=1, 2, 3, . . . , K.

Next, binaural audio calculation block 530 applies head-related transfer functions (HRTFs) to each of the plurality of beam channels and associated rotated beam angles. For example, in one embodiment, binaural audio calculation block 530 may generate a plurality of binaural audio signals by applying K HRTFs to the plurality of beam channels, assuming K sources of sound located at K angles (e.g., K rotated beam angles) at certain distances. In some cases, the distances may be a fixed distance. For example, the fixed distance may be approximately 1 meter. In other cases, the distances may be estimated distances. For example, the estimated distances may be provided by a speaker tracking function that is integrated with the encoding apparatus (e.g., encoding apparatus 110) or with the headset (e.g., headset 170).

After applying the HRTFs to the plurality of beam channels, binaural audio calculation block 530 generates the plurality of binaural audio signals 540. In this embodiment, the plurality of binaural audio signals 540 may be K binaural audio signals (i.e., 2K channels) that are provided to a binaural audio mixer 550. At binaural audio mixer 550, the plurality of binaural audio signals 540 are combined into a single binaural audio channel signal 560. Binaural audio mixer 550 may combine the plurality of binaural audio signals 540 by applying a down mixing technique to the multiple channels to produce single binaural audio channel signal 560. Single binaural audio channel signal 560 may then be provided to headset 170 for reproduction through left and right speakers (e.g., left speaker 172 and right speaker 174 shown in FIG. 1).

Figure 6:
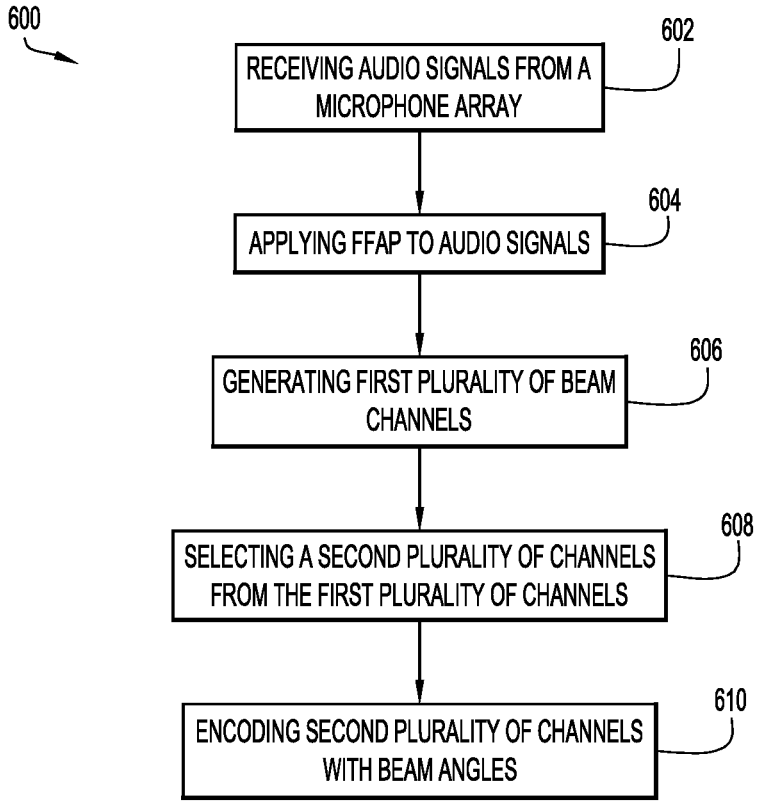
FIG. 6 is a flowchart illustrating a method of encoding audio signals, according to an example embodiment.
Figure 7:
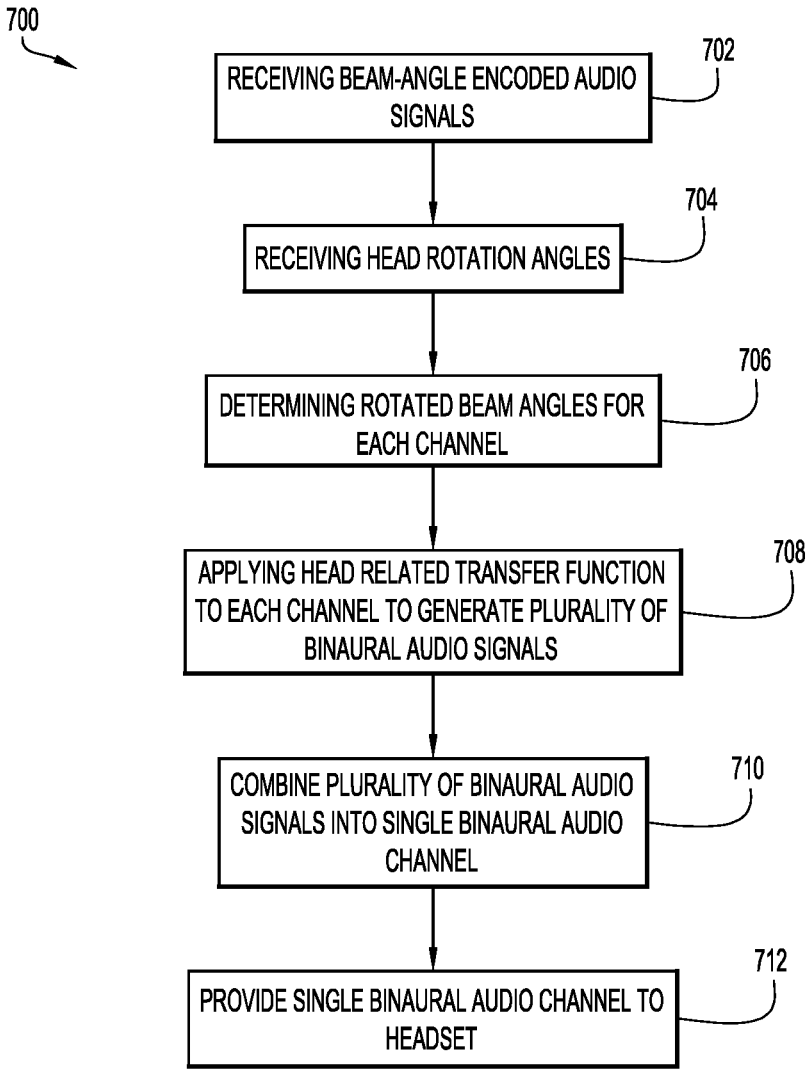
FIG. 7 is a flowchart illustrating a method of rendering binaural audio for a headset, according to an example embodiment.

Referring now to FIGS. 6 and 7, flowcharts illustrating the method of encoding audio signals (FIG. 6) and rendering binaural audio (FIG. 7) according to the example embodiments described herein are shown. The steps of the methods shown in FIGS. 6 and 7 may be performed by any suitable component for providing the operations described. For example, a single device or apparatus may include the necessary components to perform both the encoding operations and the rendering operations. In another example, each set of encoding operations and rendering operations may be performed by an apparatus configured for those operations, (e.g., encoding operations performed by encoding apparatus 110 and rendering operations performed by rendering apparatus 150). In still another example, any of the various steps within each set of encoding operations and rendering operations may be performed by one or more of the same or different components in one apparatus or many separate apparatuses.

FIG. 6 is a flowchart for a method 600 of encoding audio signals, according to an example embodiment. In this embodiment, method 600 may begin at an operation 602 that includes receiving audio signals from a microphone array. For example, receiving audio signals from microphone array 126 having a plurality of microphone elements 128A-N. Next, at an operation 604, far-field array processing (FFAP) may be applied to the audio signals received at operation 602. For example, FFAP may include various audio processing techniques applied to the audio signals, as described above. At an operation 606, a first plurality of channels are generated by the FFAP performed during operation 604. In an example embodiment, the first plurality of channels are a plurality of beam channels that have a particular beam angle associated with each channel.

Next, at an operation 608, a second plurality of channels are selected from the first plurality of beam channels to form a subset of the first plurality of beam channels. For example, as described above with reference to FIG. 4, a defined activity criteria may be applied during operation 608 to select a number of the most active channels from the first plurality of beam channels. Once the most active channels forming the second plurality of channels have been selected at operation 608, each channel of the second plurality of channels is encoded with its particular beam angle information for that channel at an operation 610. Once operation 610 finishes encoding the audio signals, the encoded audio signals are configured to provide binaural audio to a headset. The encoded audio signals are then in a format to be provided to a rendering apparatus or other component configured to render the binaural audio to a headset. For example, the encoded audio signals may be directly or indirectly transmitted or sent to the apparatus that will render the encoded audio signals for playback on the headset, or the encoded audio signals may be saved to a storage medium to be provided for rendering binaural audio at a later time.

FIG. 7 is a flowchart for a method 700 of rendering binaural audio for a headset, according to an example embodiment. In this embodiment, method 700 may begin at an operation 702 that includes receiving beam-angle encoded audio signals. The beam-angle encoded audio signals may include a plurality of channels that are each associated with a particular beam angle for that channel. For example, beam-angle encoded audio signals may be received from an encoding apparatus (e.g., encoding apparatus 110) or from storage media, as described above with regard to operation 610 of method 600. Next, at an operation 704 one or more head rotation angles may be received. For example, head rotation angles may be provided at operation 704 from a head tracking sensor associated with a headset, for example, head tracking sensor 176 of headset 170 shown in FIG. 1.

Next, at an operation 706, rotated beam angles are determined for each channel of the plurality of channels from the beam-angle encoded audio signals received at operation 702. For example, determining the rotated beam angle for each channel may include subtracting the head rotation angle received at operation 704 from each of the particular beam angles for the plurality of channels from the encoded audio signals. Once rotated beam angles have been determined at operation 706, an operation 708 may apply head-related transfer functions (HRTFs) to each channel of the plurality of channels to generate a plurality of binaural audio signals.

After operation 708 generates the plurality of binaural audio signals, the signals may be combined at an operation 710 into a single binaural audio channel. For example, as described above with reference to FIG. 5, combining the plurality of binaural audio signals into a single binaural audio channel at operation 710 may include a down mixing operation.

Finally, at an operation 712, the single binaural audio channel generated by operation 710 is provided to a headset for playback of the audio signal. For example, the single binaural audio channel from operation 712 may be configured to produce sound to be reproduced on left speaker 172 and right speaker 174 of headset 170, as shown in FIG. 1. According to the example embodiments, method 700 may be repeated one or more times to render an immersive sound recording for playback on headset 170.

The encoding, decoding, and rendering operations described herein may use standard multi-channel or multi-object codecs, such as Opus, MPEG-H, Spatial Audio Object Coding (SAOC), or other suitable codecs.

The principles of the example embodiments described herein can automatically compensate for head movement provided by AR/VR headsets with integrated head tracking sensors that can detect a user's head movement by providing sound field rotation in the far-field processing domain.

The example embodiments can capture multi-channel 3D audio in a meeting or other environment using far-field array processing technology, encode the audio signals, transmit the bit stream, decode the bit stream in the far-end, and then render rotatable binaural immersive audio using a wearable AR/VR headset.

In summary, a method of encoding audio signals to provide binaural audio to a headset is provided, the method comprising: receiving audio signals from a microphone array comprising a first plurality of elements; applying far-field array processing to the audio signals received from the first plurality of elements of the microphone array to generate a first plurality of channels, wherein the first plurality of channels are beam channels and each beam channel is associated with a particular beam angle; selecting a second plurality of channels from the first plurality of channels, wherein the second plurality of channels is a subset of the first plurality of channels; and encoding the audio signals from the selected second plurality of channels with information associated with the particular beam angle for each of the selected second plurality of channels, wherein the encoded audio signals are configured to provide binaural audio to a headset.

In addition, a method of rendering binaural audio for a headset is provided, the method comprising: receiving audio signals comprising a plurality of channels, wherein each channel is associated with a particular beam angle for that channel; receiving a signal associated with a head rotation angle from a head tracking sensor of a headset; determining a rotated beam angle for each of the particular beam angles associated with the plurality of channels; generating a plurality of binaural audio signals by applying a head related transfer function to each channel of the plurality of channels; combining the plurality of binaural audio signals into a single binaural audio channel; and providing the single binaural audio channel to the headset.

In addition, an apparatus for encoding audio signals to provide binaural audio to a headset is provided comprising: a microphone array comprising a first plurality of elements; at least one processor in communication with the microphone array and configured to: receive audio signals from the first plurality of elements; apply far-field array processing to the received audio signals to generate a first plurality of channels, wherein the first plurality of channels are beam channels and each beam channel is associated with a particular beam angle; select a second plurality of channels from the first plurality of channels, wherein the second plurality of channels is a subset of the first plurality of channels; and encode the audio signals from the selected second plurality of channels with information associated with the particular beam angle for each of the selected second plurality of channels, wherein the encoded audio signals are configured to provide binaural audio to a headset.

In addition, an apparatus for rendering binaural audio for a headset is provided comprising: a headset comprising a left speaker and a right speaker; at least one processor in communication with the headset and configured to: receive audio signals comprising a plurality of channels, wherein each channel is associated with a particular beam angle for that channel; receive a signal associated with a head rotation angle from a head tracking sensor of the headset; determine a rotated beam angle for each of the particular beam angles associated with the plurality of channels; generate a plurality of binaural audio signals by applying a head related transfer function to each channel of the plurality of channels; combine the plurality of binaural audio signals into a single binaural audio channel; and provide the single binaural audio channel to the headset.

Furthermore, a non-transitory computer readable storage media encoded with instructions that, when executed by a processor, cause the processor to perform operations is provided comprising: receiving audio signals from a microphone array comprising a first plurality of elements; applying far-field array processing to the audio signals received from the first plurality of elements of the microphone array to generate a first plurality of channels, wherein the first plurality of channels are beam channels and each beam channel is associated with a particular beam angle; selecting a second plurality of channels from the first plurality of channels, wherein the second plurality of channels is a subset of the first plurality of channels; and encoding the audio signals from the selected second plurality of channels with information associated with the particular beam angle for each of the selected second plurality of channels, wherein the encoded audio signals are configured to provide binaural audio to a headset.

Furthermore, a non-transitory computer readable storage media encoded with instructions that, when executed by a processor, cause the processor to perform operations is provided comprising: receiving audio signals comprising a plurality of channels, wherein each channel is associated with a particular beam angle for that channel; receiving a signal associated with a head rotation angle from a head tracking sensor of a headset; determining a rotated beam angle for each of the particular beam angles associated with the plurality of channels; generating a plurality of binaural audio signals by applying a head related transfer function to each channel of the plurality of channels; combining the plurality of binaural audio signals into a single binaural audio channel; and providing the single binaural audio channel to the headset.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. A method of encoding audio signals to provide binaural audio to a headset, the method comprising:

receiving audio signals from a microphone array comprising a first plurality of elements;

generating a first plurality of channels based on the audio signals received from the first plurality of elements of the microphone array, wherein the first plurality of channels are active beam channels and each active beam channel of the first plurality of channels is associated with a particular beam angle for that active beam channel;

selecting a second plurality of channels from the first plurality of channels that satisfy a defined activity criteria among the active beam channels of the first plurality of channels, wherein the second plurality of channels is a subset of the first plurality of channels and includes a smaller number of channels than the first plurality of channels;

including a beam identifier, instead of a corresponding particular beam angle, with each of the selected second plurality of channels, wherein the beam identifier is a number that represents an association of a channel of the selected second plurality of channels with the corresponding particular beam angle;

estimating, using a speaker tracking function, a distance from a sound source for each of the selected second plurality of channels; and encoding the audio signals from the selected second plurality of channels with information associated with the particular beam angle and the distance for each of the selected second plurality of channels, wherein the encoded audio signals are configured to provide the binaural audio to the headset.

2. The method of claim 1, wherein the second plurality of channels are the most active channels of the first plurality of channels.

3. The method of claim 1, wherein the defined activity criteria is based on at least one of a sound pressure level or a sound pressure ratio.

4. The method of claim 1, wherein the defined activity criteria is based on at least one of a signal-to-noise ratio or a signal-to-reverberation ratio.

5. The method of claim 1, wherein the second plurality of channels are configured to cover at least between 180 to 360 degrees of a three-dimensional space of environment 180 continuous degrees.

6. The method of claim 1, wherein the particular beam angle of each beam channel is a fixed angle.

7. The method of claim 1, wherein the microphone array is one of a linear array, a planar array, a circular array, or a spherical array.

8. The method of claim 1, further comprising:

directly transmitting the encoded audio signals configured to provide the binaural audio to the headset, wherein the first plurality of channels are virtual microphone channels.

9. A method of rendering binaural audio for a headset, the method comprising:

receiving audio signals comprising a plurality of channels, wherein each channel is encoded with information associated with a particular beam angle for that channel, wherein the information includes a beam identifier which is a number that represents an association of a beam channel with a corresponding particular beam angle for the beam channel;

receiving a signal associated with a head rotation angle from a head tracking sensor of the headset;

determining a rotated beam angle for each of the particular beam angles associated with each channel of the plurality of channels by subtracting the head rotation angle received from the head tracking sensor from the particular beam angle for the beam channel determined based on the beam identifier;

after determining the rotated beam angle for each of the particular beam angles associated with each channel of the plurality of channels, generating a plurality of binaural audio signals by applying a head related transfer function to each channel of the plurality of channels, wherein the head related transfer function of each channel of the plurality of channels is based on a plurality of sound sources being located at certain distances estimated by a speaker tracking function integrated with the headset;

combining the plurality of binaural audio signals into a single binaural audio channel; and providing the single binaural audio channel to the headset.

10. The method of claim 9, further comprising extracting the plurality of channels and associated particular beam angle for each channel, wherein beam identifiers in the information are retrieved from a table.

11. The method of claim 9, wherein the association between the beam identifier and the corresponding particular beam angle for the beam channel is stored in a table.

12. The method of claim 9, wherein applying the head related transfer function to each channel is based on a sound source at a fixed distance.

13. The method of claim 9, wherein applying the head related transfer function to each channel is based on a sound source having an estimated distance.

14. The method of claim 9, wherein the particular beam angle of each beam channel is a fixed angle.

15. An apparatus for encoding audio signals to provide binaural audio to a headset comprising:

a microphone array comprising a first plurality of elements;

at least one processor in communication with the microphone array and configured to:

receive the audio signals from the first plurality of elements;

generate a first plurality of channels based on the audio signals, wherein the first plurality of channels are active beam channels and each active beam channel of the first plurality of channels is associated with a particular beam angle for that active beam channel;

select a second plurality of channels from the first plurality of channels that satisfy a defined activity criteria among the active beam channels of the first plurality of channels, wherein the second plurality of channels is a subset of the first plurality of channels and includes a smaller number of channels than the first plurality of channels;

include a beam identifier, instead of a corresponding particular beam angle, with each of the selected second plurality of channels, wherein the beam identifier is a number that represents an association of a channel of the second plurality of channels with the corresponding particular beam angle;

estimate, using a speaker tracking function, a distance from a sound source for each of the selected second plurality of channels; and encode the audio signals from the selected second plurality of channels with information associated with the particular beam angle and the distance for each of the selected second plurality of channels, wherein the encoded audio signals are configured to provide the binaural audio to the headset.

16. The apparatus of claim 15, wherein the defined activity criteria is based on at least one of a sound pressure level, a sound pressure ratio, a signal-to-noise ratio, or a signal-to-reverberation ratio.

17. The apparatus of claim 15, wherein the second plurality of channels are configured to cover at least between 180 to 360 degrees of a three-dimensional space of environment.

18. The apparatus of claim 15, wherein the microphone array is one of a linear array, a planar array, a circular array, or a spherical array.

19. The apparatus of claim 15, wherein the defined activity criteria is based on at least one of a sound pressure level or a sound pressure ratio.

20. The apparatus of claim 15, wherein the second plurality of channels are the most active channels of the first plurality of channels.

* * * * *